United States Patent [19]

Iwasaki et al.

[11] Patent Number: 4,600,858

[45] Date of Patent: Jul. 15, 1986

[54] COLOR CATHODE RAY TUBE APPARATUS TO MODIFY DEFLECTION MAGNETIC FIELDS

[75] Inventors: Katsuyo Iwasaki, Nishinomiya; Osamu Konosu, Nagaokakyo; Atsushi Kihara, Uji; Masayasu Kamada, Muko, all of Japan

[73] Assignee: Matsushita Electronics Corp., Kadoma, Japan

[21] Appl. No.: 609,009

[22] Filed: May 10, 1984

[30] Foreign Application Priority Data

May 18, 1983 [JP] Japan ..... 58-86994

[51] Int. Cl.[4] ..... H01J 29/50

[52] U.S. Cl. ..... 313/413; 313/428; 313/431; 315/8; 315/370; 335/211

[58] Field of Search ..... 313/413, , 414, 428, 313/431; 315/8, 370; 335/211, 212

[56] References Cited

U.S. PATENT DOCUMENTS

| | | | |
|---|---|---|---|
| 2,880,367 | 3/1959 | Caprio | 315/27 |
| 4,415,831 | 11/1983 | Konosu | 313/413 |
| 4,433,268 | 2/1984 | Arisato | 313/440 |

*Primary Examiner*—Davis L. Willis
*Assistant Examiner*—William L. Oen
*Attorney, Agent, or Firm*—Cushman, Darby & Cushman

[57] ABSTRACT

In a cathode ray tube apparatus having an in-line type electron gun, magnetic pole pieces comprising four pole pieces of substantially arc-shaped cross section are disposed in a cylindrical shape with circumferential gaps between neighboring pole pieces 0°, 90°, 180°, and 270° locations on the cylinder. An additional pair of narrow width stripe-shaped pole pieces are disposed inside said cylinder at a predetermined distance from the cylinder in a manner to cover the 90° and 180° gaps. The apparatus acting to modify the horizontal and vertical deflection magnetic fields so that the electron beam spots on the phosphor CRT screen are substantially circular in shape without losing the self convergence effect of the magnetic fields.

14 Claims, 16 Drawing Figures

FIG. 5 (a) (Prior Art)
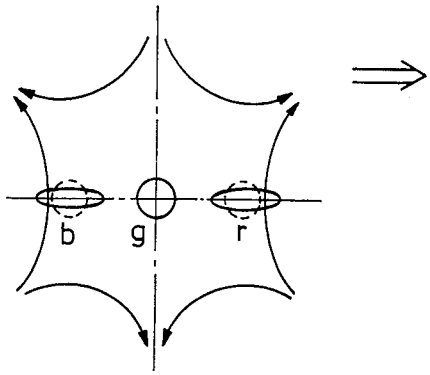
FIG. 5 (b) (Prior Art)
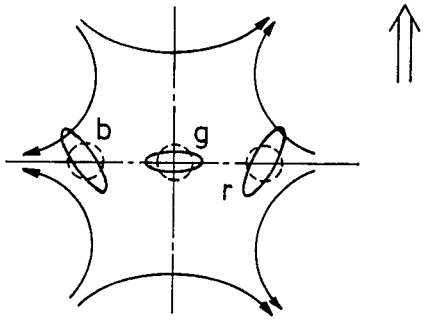
FIG. 6
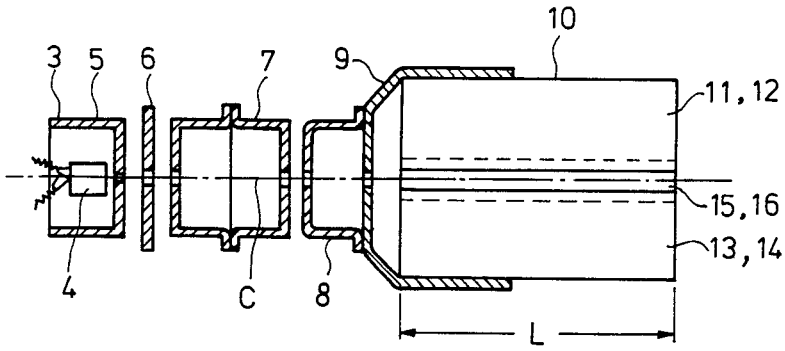

COLOR CATHODE RAY TUBE APPARATUS TO MODIFY DEFLECTION MAGNETIC FIELDS

BACKGROUND OF THE INVENTION

1. Field of the Technology

The present invention relates to a color cathode ray tube apparatus of the type which includes an in-line electronic gun and a deflection yoke for producing a pincushion type horizontal deflection magnetic field and a barrel type vertical deflection magnetic field.

2. Description of the Prior Art

In general, a deflection yoke to be applied on a color cathode ray tube apparatus which includes an in-line type electron gun, is designed to produce a pincushion type horizontal deflection magnetic field shown in FIG. 1 and barrel type vertical deflection magnetic field shown in FIG. 2. Therefore, such conventional color cathode ray tube apparatus does not require any complex convergence circuit, and can be designated as a self-convergence system. However, such conventional apparatus has a problem in that the electron beam spots produced by projection on a phosphor screen become elliptic shapes as shown in FIG. 3, as designated by b, g and r respectively for blue, green and red beam spots corresponding to the electron beams from the electron gun beam outlets B, G and R, thereby lowering resolution.

It is considered that as shown in FIG. 4(*a*), the pincushion type horizontal deflection magnetic field can be decomposed into a uniform magnetic field 1*a* and a positive six pole magnetic field component 2*a*. Likewise, the barrel type vertical deflection magnetic field can be decomposed into a uniform magnetic field 1*b* and a negative six pole magnetic field component 2*b*. Therefore, it can be seen that the distortions of the beam spots b, g and r are produced by the positive and negative six pole magnetic field components 2*a* and 2*b* as shown in FIG. 5(*a*) and FIG. 5(*b*). As a result, the beam spot distortion produces discolorations similar to those caused by misconvergences between the central electron beam from the central electron gun and the side electron beams from the side electron guns, thereby leading to poor resolution.

SUMMARY OF THE INVENTION

Accordingly, the present invention provides for an improved color cathode ray tube apparatus having high resolution by producing substantially circular beam spots on the entire phosphor screen of the cathode ray tube without losing advantages of the self-convergence function.

The present invention is based on the inventors' studies and finding that, in view of the major effects magnetic fields have on the shape of beam spots, by provision of control magnetic pole pieces of a certain shape and disposition in the magnetic field at the outlet part of the electron gun, the shapes of beam spots on various parts of the phosphor screen can be corrected. That is, by superimposing an additional negative six pole magnetic field component on the conventional horizontal deflection magnetic field and by superimposing an additional positive six pole magnetic field component on the conventional vertical deflection magnetic field, an improved pincushion type horizonal deflection magnetic field and an improved barrel type vertical deflection magnetic field are obtainable. In order to realize the above-mentioned finding, the inventors proposed:

a color cathode ray tube apparatus having an electron gun of the in-line type, a vacuum enclosure having a neck part which contains the electron gun and on which a vertical deflection magnetic field and a horizontal deflection magnetic field are to be applied, a cone part and a panel part, and a phosphor screen formed on an inside face of the panel part, characterized in that the electron gun has control magnetic pole pieces at the electron-beam outlet, the control magnetic pole pieces shaped in a cylinder comprising first, second, third and fourth pole pieces, having arc-shape cross sections and disposed with gaps between neighboring pieces on located a vertical central plane and on a horizontal central plane, and fifth and sixth pole pieces having arc-shaped cross sections disposed inside the cylinder and at positions to cover the gaps which cross the horizontal plane, with a predetermined radial gap between the fifth and sixth pole piece and the cylinder.

BRIEF DESCRIPTION OF THE DRAWINGS

FIG. 4(*b*) is a schematical view showing the magnetic field distribution of the conventional barrel type vertical deflection field.

FIG. 5(*a*) is a schematical view showing the relation between the positive six pole magnetic field components and shape distortion of the beam spots in the horizontal deflections.

FIG. 5(*b*) is a schematical view showing the relation between the negative six pole magnetic field components and shape distortion of the beam spots in the horizontal deflections.

FIG. 6 is a sectional side view of an electron gun embodying the present invention.

DESCRIPTION OF THE PREFERRED EMBODIMENTS

A first preferred embodiment is described with reference to FIG. 6, FIG. 7, FIG. 8, FIG. 9, FIG. 10 and FIG. 11.

Figure 1:
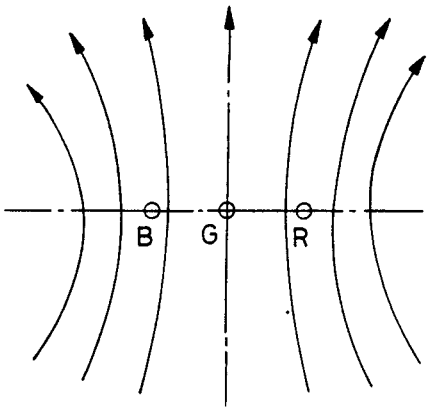
FIG.1 (Prior Art)
FIG. 1 is a schematic representation of the magnetic field distribution of the known conventional pincushion type horizontal deflection field.
Figure 2:
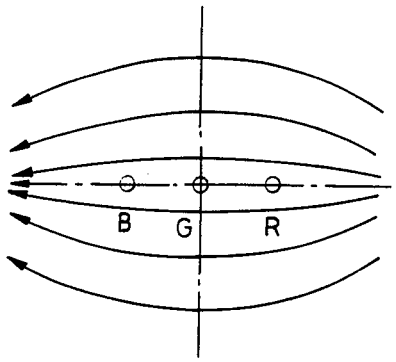
FIG.2 (Prior Art)
FIG. 2 is a schematic representation of the magnetic field distribution of the known conventional barrel type vertical deflection field.
Figure 3:
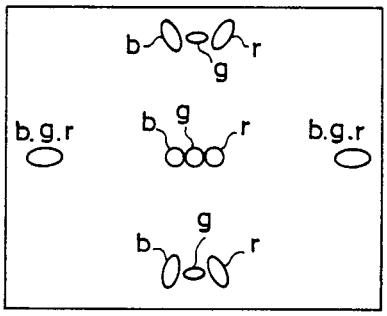
FIG.3 (Prior Art)
FIG. 3 is the schematical front view of the phosphor screen of the conventional cathode ray tube apparatus schematically showing shape distortions of beam spots on various parts on the phosphor screen.
Figure 4:
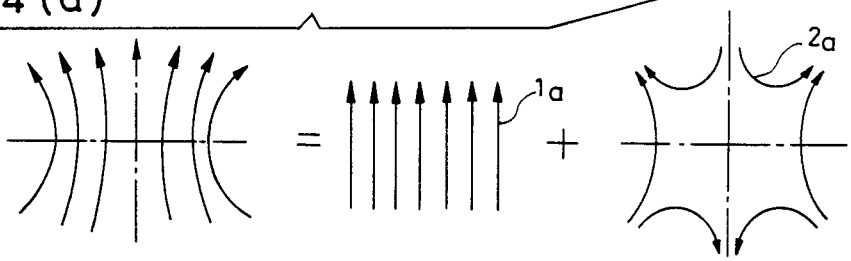
FIG. 4(*a*) is a schemetical view showing the magnetic field distribution of the conventional pincushion type horizontal deflection field.
Figure 4:
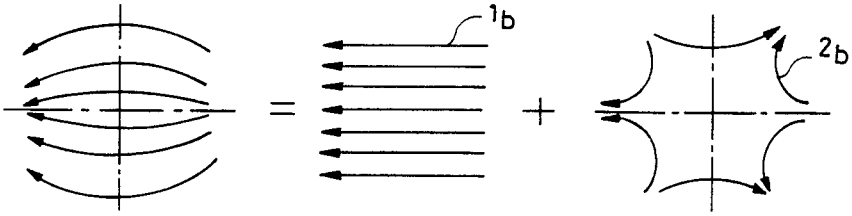
Figure 7:
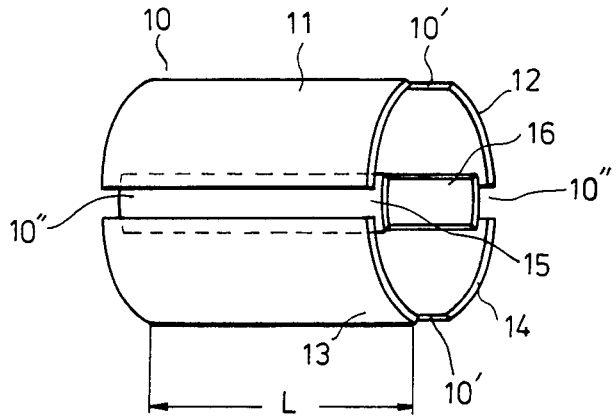
FIG. 7 is a perspective view of magnetic pole pieces of an electron gun according to the present invention.
Figure 8:
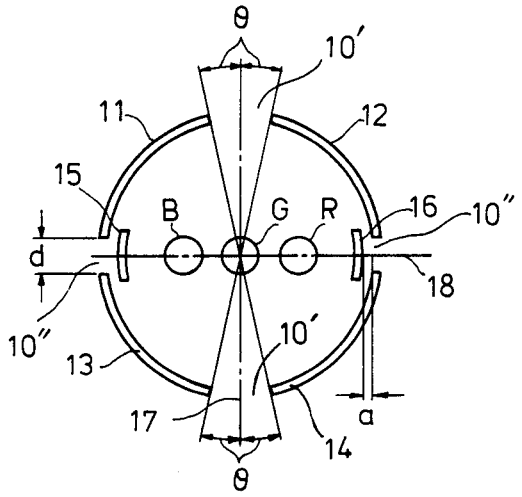
FIG. 8 is a front view of the magnetic pole pieces of FIG. 7.

An important feature of the present invention is the configuration of the pole pieces at the outlet of the electron gun in the cathode ray tube apparatus. As shown in FIG. 6, the electron gun comprises a cathode 4, a control grid 5, a first acceleration electrode 6, a convergence electrode 7 and a final acceleration electrode 8. On top of the above-mentioned known configuration, additional magnetic pole pieces 10 are provided by being held in a cap-shaped member 9 which is fixed on the outlet end of the final acceleration electrode 8. The magnetic pole piece unit 10 is for adjusting the magnetic field distribution of the deflection magnetic fields at the end of the electron beam outlet, and comprises, as shown in FIG. 7 and FIG. 8, a cylinder, made up of magnetic pole pieces 11, 12, 13 and 14 which have arc-shaped cross-sections, having its center on the axis of the electron gun. The magnetic pole pieces 11, 12, 13 and 14 are substantially in symmetry with respect to a vertical central plane and horizontal central plane each containing the electron gun axis thereon, and the pole pieces 11, 12, 13 and 14 are disposed with circumferential gaps 10′ on the vertical central plane and 10″ on the horizontal central plane, respectively. A pair of narrow width pole pieces 15 and 16 are disposed inside the cylinder, as if covering the gaps 10″ at a predetermined gap "a" from the cylinder. The length of the narrow width pole pieces 15 and 16 are substantially the same as the lengths of the arc-shaped pole pieces 11, 12, 13 and 14, and the width of the pole pieces 15 and 16 are smaller than those of the pole pieces 11, 12, 13 and 14.

As was described above, the pole pieces 11, 12, 13 and 14 are disposed in a cylindrical shape which has its axis parallel to the axis of the electron gun, and the upper two pole pieces 11 and 12 make an upper pair which are disposed symmetrically with respect to the vertical central plane. The lower two pieces 13 and 14 also make a symmetric pair with respect to the vertical central plane. On the other hand, the pole pieces 11 and 13 make a vertical symmetric pair with respect to the horizontal central plane, and the other two pole pieces 12 and 14 also make another vertical symmetric pair with respect to the horizontal central plane. The fifth and sixth pole pieces 15 and 16 also make a symmetric pair with respect to the vertical plane. As shown in FIG. 8, the vertical symmetric pair 11 and 13 or 12 and 14 have circumferential gap d between neighboring edges. The horizontal symmetric pair 11 and 12 or 13 and 14 have a gap which forms an angle of $2\theta$ with respect to the axis.

Figure 9:
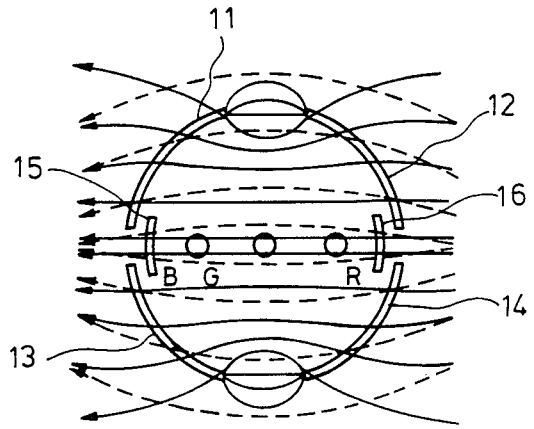
FIG. 9 is a diagram of the magnetic field distribution of the vertical deflection field caused by the pole pieces of FIG. 7 and FIG. 8.
Figure 9:
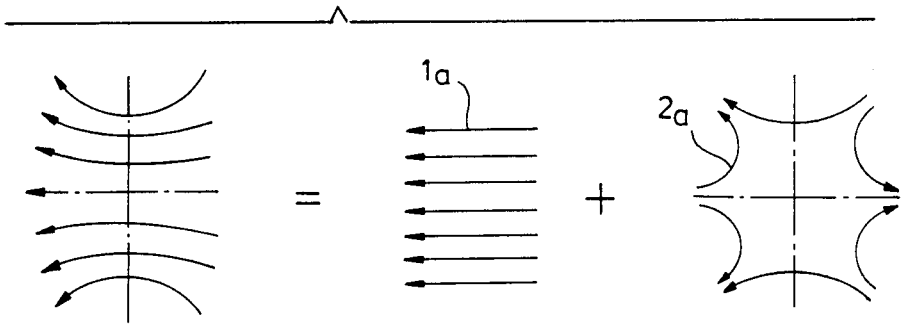

In a cathode ray tube apparatus constructed as indicated above, the barrel type vertical deflection magnetic field is modified to that shown by solid lines from that shown by broken lines in FIG. 9(*a*). At the outlet side of the electron gun the field is modified to a pincushion shape magnetic field distribution, thereby forming a magnetic field including a positive six pole magnetic field component.

FIG. 9(*b*) shows decomposed components of the pincushion shape modified vertical deflection magnetic field of FIG. 9(*a*), which shows that the pincushion shape magnetic field is a superposition of a horizontal uniform two pole magnetic field and a horizontal positive six pole magnetic field.

Figure 10:
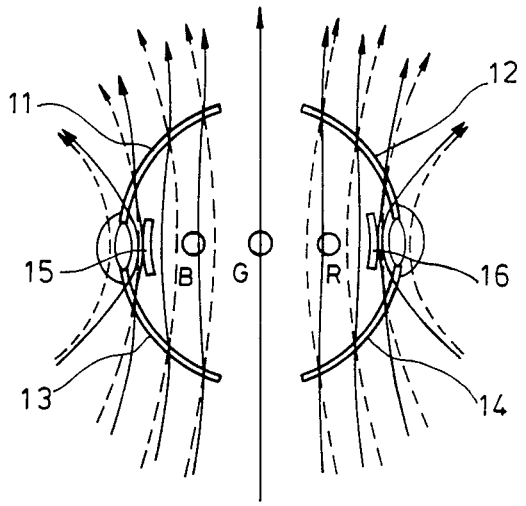
FIG. 10 is a diagram of the magnetic field distribution of the horizontal deflection field caused by the pole pieces of FIG. 7 and FIG. 8.
Figure 10:
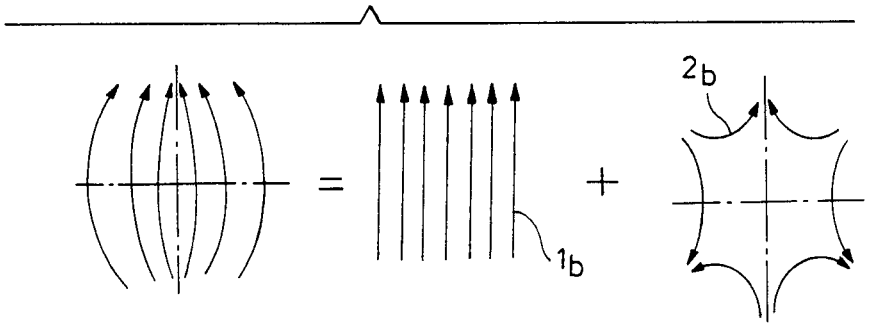

On the other hand, the pincushion type horizontal deflection magnetic field is modified to that shown by solid lines from that shown by broken lines in FIG. 10(*a*). At the outlet side of the electron gun the field is modified to a pincushion shape magnetic field distribution, thereby forming a magnetic field including a negative six pole magnetic field component.

FIG. 10(*b*) shows decomposed components of the barrel shape modified horizontal deflection magnetic field of FIG. 10(*a*), which shows that the pincushion type magnetic field is a superposition of a vertical uniform two pole magnetic field and a vertical negative six pole magnetic field. This barrel shape modification is produced by the attracting actions of the fifth magnetic pole piece 15 and the six magnetic pole piece 16 as shown in FIG. 10(*a*).

Figure 11:
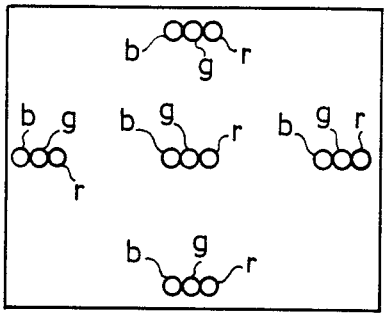
FIG. 11 is a schematical front view of a phosphor screen schematically showing shapes of beam spots at various parts of the screen in accordance with the present invention.

As a result of the above-mentioned modification of the vertical deflection magnetic field into a modified pincushion shape as shown in FIG. 9(*a*) and the modification of the horizontal deflection magnetic field into a modified barrel shape as shown in FIG. 10(*a*), all electron beam spots on the phosphor screen, including the upper end, lower end, left end, right end, and four corners of the screen can achieve a substantially circular shape as schematically shown in FIG. 11. The extent to which the beam spots are changed to the substantially circular shape is determined by the axial length L of the first, second, third, fourth, fifth and sixth magnetic pole pieces 11, 12, 13, 14, 15, 16, and angle $2\theta$ of the upper and lower circumferential gap opening seen from the central axis. It is recommended that when distortion of the beam spot is large, the axial length L of the magnetic pole pieces should be longer, and the opening angle $\theta$ should be smaller. The vertical gaps d are helpful in suppressing a decrease of horizontal deflection efficiency, and the fifth and sixth magnetic pole pieces 15, 16 serve to minimize the difference of deflection distortions on a horizontal line between the two side electron beams from the electron beam outlets B and R. The optimum relation between the width d of the horizontal gap 18, 18′ and the gap a between the cylinder wall and the outside face of the fifth and sixth magnetic pole pieces 15 and 16 are experimentally found as $d=1.9a/1.75$.

Figure 12:
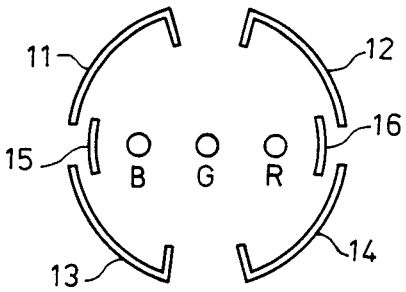
FIG. 12 is a front view of the magnetic pole pieces of a modified embodiment of the present invention.

FIG. 12 shows a modified example of the magnetic pole pieces which can be used instead of the magnetic pole pieces of FIG. 7 through FIG. 10. That is, first, second, third and fourth magnetic pole pieces 11, 12, 13, 14 have inside-bents. Such inside-bents are helpful in efficiently modifying the magnetic field into the pincushion shape vertical deflection magnetic field.

The first through the sixth magnetic pole pieces 11–16 may be shapes other than exact arc cross sections, that is the cross sectional shape can be a polygonal shape, if the shape is substantially analogous to the arc shape.

Figure 13:
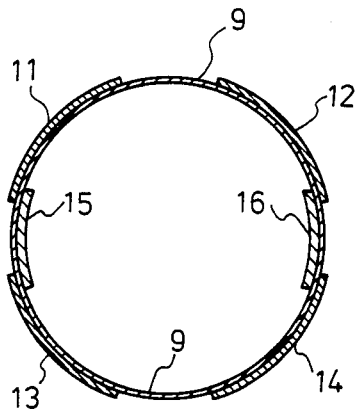
FIG. 13 is an end view of the magnetic pole pieces of a third embodiment of the present invention.

FIG. 13 shows another embodiment of the present invention. The magnetic pole pieces 11, 12, . . . 16 may be disposed in such a manner that the arc-shaped magnetic pole pieces 11, 12, 13 and 14 are disposed outside of the cup-shaped member 9 and the fifth and sixth magnetic pole pieces 15, 16 are disposed inside the cup-shaped member 9.

Figure 14:
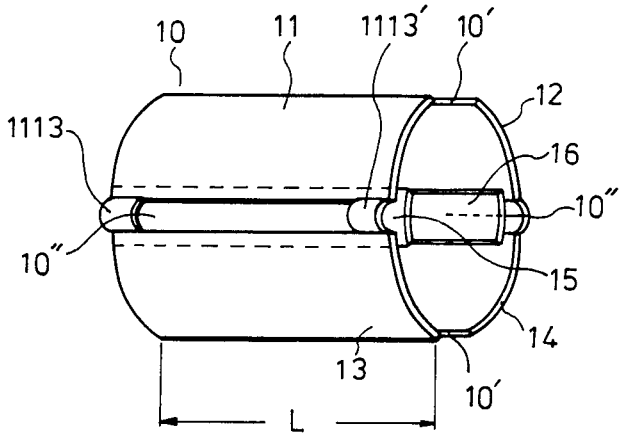
FIG. 14 is a perspective view of the magnetic pole pieces of another embodiment of the present invention.

Another embodiment of the magnetic pole pieces is shown in FIG. 14, wherein magnetic pole pieces 11 and 13 are made from a continuous sheet with a longitudinal slit 10 inbetween. The magnetic pole pieces 12 and 14 are also formed in the same manner. Bridging members 1113 and 1113' are provided to connect the upper magnetic pole piece 11 and the lower magnetic pole piece 13, but the bridging members 1113, 1113' are preferably shaped very narrow and bent outside, so as to produce a large magnetic reluctance therein.

The magnetic pole pieces comprising first to sixth pole pieces can modify the vertical deflection magnetic field into the desirable pincushion shape distribution and also modify the horizontal deflection magnetic field into desirable barrel shape magnetic field distribution at the outlet side of the electron gun. Therefore, the electron beams illuminate spots on the phosphor screen, which are substantially circular in shape over the entire phosphor screen without losing the self-convergence effect.

What is claimed is:

1. In a color cathode ray tube apparatus having an in-line electron gun which has a beam outlet portion and upon which a vertical and a horizontal deflection magnetic field are to be applied, and having a phosphor screen upon which electron beams from said electron gun are directed to form beam spots, an apparatus for modifying said vertical and said horizontal deflection magnetic fields so that said beam spots are substantially circular, comprising:

first, second, third and fourth magnetic pole pieces, each having an arc-shaped cross section, together forming a cylindrical-shaped surface through which a vertical central plane and a horizontal central plane pass such that a line formed by the intersection of said planes is colinear with a central axis of said cylindrical surface, said cylindrical surface adapted for connection to said beam outlet portion inside of said cathode ray tube and having circumferential gaps between neighboring pole pieces, said gaps located on said vertical and said horizontal central planes; and fifth and sixth magnetic pole pieces of oblong shape disposed inside said cylindrical surface at positions to cover said gaps on said horizontal central plane at a predetermined distance from said cylindrical surface, to modify said vertical and said horizontal deflection magnetic fields.

2. A color cathode ray tube apparatus in accordance with claim 1, wherein said fifth and sixth pole pieces have a smaller width than those of said first through fourth pole pieces.

3. A color cathode ray tube apparatus in accordance with claim 1, wherein said first and third pole pieces are disposed substantially in symmetry with respect to said horizontal central plane and are made of a continuous metal sheet with a long slit therein to act as the circumferential gap between said first and third pole pieces, and said second and fourth pole pieces are disposed substantially in symmetry with respect to the horizontal central plane and are made of a continuous metal sheet with a long slit therein to act as the circumferential gap between said second and fourth pole pieces.

4. In a color cathode ray tube apparatus having an in-line electron gun which has a beam outlet portion and upon which a vertical and a horizontal deflection magnetic field are to be applied, and having a phosphor screen upon which electron beams from said electron gun are directed to form beam spots, an apparatus for modifying said vertical and said horizontal deflection magnetic fields so that said beam spots are substantially circular, comprising:

first, second, third and fourth magnetic pole pieces, each having an oblong shape and an arc-shaped cross section, together forming a cylindrical-shaped surface through which a vertical central plane and a horizontal central plane pass such that a line formed by the intersection of said planes is colinear with a central axis of said cylindrical surface, said cylindrical surface adapted for connection to said beam outlet portion inside said cathode ray tube and having circumferential gaps between neighboring pole pieces, said gaps located on said vertical and said horizontal central planes, said pole pieces disposed in substantial symmetry with respect to said vertical and said horizontal central planes; and fifth and sixth magnetic pole pieces each having an oblong shape and an arc-shaped cross section which is shorter than the arc-shaped cross section of said first, second, third, and fourth pole pieces, disposed inside said cylindrical surface at positions to cover said circumferential gaps on said horizontal central plane at a predetermined distance from said cylindrical surface, to modify said horizontal and said vertical deflection magnetic fields.

5. A color cathode ray tube apparatus in accordance with claim 4, wherein said fifth and sixth pole pieces have a smaller width than those of said first through fourth pole pieces.

6. A color cathode ray tube apparatus in accordance with claim 4, wherein said first and third pole pieces are disposed substantially in symmetry with respect to said horizontal central plane and are made of a continuous metal sheet with a long slit therein to act as the circumferential gap between said first and third pole pieces, and said second and fourth pole pieces are disposed substantially in symmetry with respect to said horizontal central plane and are made of a continuous metal sheet with a long slit therein to act as the circumferential gap between said second and fourth pole pieces.

7. In a color cathode ray tube apparatus having an in-line electron gun which has a beam outlet portion and a cup-shaped member having an inside surface and an outside surface and having an electron beam passing aperture at its center attached to said beam outlet portion, said electron gun having a vertical and a horizontal deflection magnetic field applied thereto, and having a phosphor screen upon which electron beams from said electron gun are directed to form beam spots, an apparatus for modifying said vertical and horizontal deflection magnetic fields so that said beam spots are substantially circular, comprising:

first, second, third and fourth magnetic pole pieces, each having an arc-shaped cross section, together forming a cylindrical shaped surface which is attached to the outside surface of said cup-shaped member inside said cathode ray tube, said cylindrical surface being quadrisected by a horizontal central plane and a vertical central plane such that a line formed by the intersection of said planes is colinear with a central axis of said cylindrical surface, said cylindrical surface having circumferential gaps between neighboring pole pieces, said gaps located on said vertical and said horizontal central planes; and fifth and sixth magnetic pole pieces of oblong shape disposed on the inside surface of said cup-shaped member so as to cover the circumferential gaps which are located on said horizontal central plane, to modify said horizontal and said vertical deflection magnetic fields.

8. A cathode ray tube apparatus in accordance with claim 7, wherein said first through fourth magnetic pole pieces are fixed to an outer surface of said cup-shaped member and said fifth and sixth magnetic pole pieces are fixed to an inner surface of said cup-shaped member.

9. A color cathode ray tube apparatus in accordance with claim 1, wherein each of said first, second, third and fourth pole pieces has an inwardly bent wing at its edge adjacent to said vertical central plane.

10. A color cathode ray tube apparatus in accordance with claim 4, wherein each of said first, second, third and fourth pole pieces has an inwardly bent wing at its edge adjacent to said vertical central plane.

11. In a color cathode ray tube apparatus having an in-line electron gun which has a beam outlet portion and upon which a pin cushion type vertical deflection magnetic field and a horizontal barrel type deflection magnetic field are applied, and having a phosphor screen upon which electron beams from said electron gun are directed to form beam spots, an apparatus for modifying said vertical and said horizontal deflection magnetic fields so that said beam spots are substantially circular, comprising:

first, second, third and fourth magnetic pole pieces, each having an arc-shaped cross section, together forming a cylindrical-shaped surface through which a vertical central plane and a horizontal central plane pass such that a line formed by the intersection of said planes is colinear with a central axis of said cylindrical surface, said cylindrical surface adapted for connection to said beam outlet portion inside of said cathode ray tube and having circumferential gaps between neighboring pole pieces, said gaps located on said vertical and said horizontal central planes; and fifth and sixth magnetic pole pieces of oblong shape disposed inside said cylindrical surface at positions to cover said gaps on said horizontal central plane at a predetermined distance from said cylindrical surface, to modify said pin cushion type vertical deflection magnetic field to a barrel shape, and said barrel type horizontal deflection magnetic field to a pin cushion shape.

12. A color cathode ray tube apparatus according to claim 11, wherein said fifth and sixth pole pieces have a smaller width than those of said first through fourth pole pieces.

13. A color cathode ray tube apparatus in accordance with claim 11 wherein said first and third pole pieces are disposed substantially in symmetry with respect to said horizontal central plane and are made of a continuous metal sheet with a long slit therein to act as the circumferential gap between said first and third pole pieces, and wherein said second and fourth pole pieces are disposed substantially in symmetry with respect to the horizontal central plane and are made of a continuous metal sheet with a long slit therein to act as the circumferential gap between said second and fourth pole pieces.

14. A color cathode ray tube apparatus in accordance with claim 11, wherein each of said first, second, third, and fourth pole pieces has an inwardly bent wing at its edge adjacent to said vertical central plane.

* * * * *